US008985248B2

(12) United States Patent
DiGiovanni et al.

(10) Patent No.: US 8,985,248 B2
(45) Date of Patent: Mar. 24, 2015

(54) CUTTING ELEMENTS INCLUDING NANOPARTICLES IN AT LEAST ONE PORTION THEREOF, EARTH-BORING TOOLS INCLUDING SUCH CUTTING ELEMENTS, AND RELATED METHODS

(75) Inventors: Anthony A. DiGiovanni, Houston, TX (US); Danny E. Scott, Montgomery, TX (US); Soma Chakraborty, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 634 days.

(21) Appl. No.: 13/208,989

(22) Filed: Aug. 12, 2011

(65) Prior Publication Data

US 2012/0037431 A1 Feb. 16, 2012

Related U.S. Application Data

(60) Provisional application No. 61/373,617, filed on Aug. 13, 2010.

(51) Int. Cl.
*E21B 10/46* (2006.01)
*E21B 10/567* (2006.01)
*E21B 10/573* (2006.01)

(52) U.S. Cl.
CPC ..... *E21B 10/5676* (2013.01); *E21B 10/5735* (2013.01)
USPC ..... 175/434

(58) Field of Classification Search
USPC ..... 175/426, 425, 434, 433
See application file for complete search history.

(56) References Cited

U.S. PATENT DOCUMENTS 3,745,623 A 7/1973 Wentorf et al.
4,148,368 A 4/1979 Evans (Continued)

FOREIGN PATENT DOCUMENTS

EP 0604211 A1 6/1994
EP 0659510 B1 4/1999

(Continued)

OTHER PUBLICATIONS

International Preliminary Report on Patentability for International Application No. PCT/US2011/047610 dated Feb. 19, 2013, 6 pages.

(Continued)

*Primary Examiner* — Kenneth L Thompson
(74) *Attorney, Agent, or Firm* — TraskBritt

(57) ABSTRACT

Cutting elements comprise a multi-portion polycrystalline material. At least one portion of the multi-portion polycrystalline material comprises a higher volume of nanoparticles than at least another portion. Earth-boring tools comprise a body and at least one cutting element attached to the body. The at least one cutting element comprises a hard polycrystalline material. The hard polycrystalline material comprises a first portion comprising a first volume of nanoparticles. A second portion of the hard polycrystalline material comprises a second volume of nanoparticles. The first volume of nanoparticles differs from the second volume of nanoparticles. Methods of forming cutting elements for earth-boring tools comprise forming a volume of superabrasive material, including forming a first portion of the superabrasive material comprising a first volume of nanoparticles. A second portion of the superabrasive material is formed comprising a second volume of nanoparticles, the second volume differing from the first volume.

20 Claims, 7 Drawing Sheets

(56) References Cited

U.S. PATENT DOCUMENTS

| | | | | |
|---|---|---|---|---|
| 4,311,490 | A | 1/1982 | Bovenkerk et al. | |
| 4,412,980 | A | 11/1983 | Tsuji et al. | |
| 4,525,179 | A | 6/1985 | Gigl | |
| 4,592,433 | A | 6/1986 | Dennis | |
| 4,604,106 | A | 8/1986 | Hall | |
| 4,605,343 | A | 8/1986 | Hibbs, Jr. et al. | |
| 4,636,253 | A | 1/1987 | Nakai et al. | |
| 4,664,705 | A | 5/1987 | Horton et al. | |
| 4,726,718 | A | 2/1988 | Meskin et al. | |
| 4,784,023 | A | 11/1988 | Dennis | |
| 4,797,241 | A | 1/1989 | Peterson et al. | |
| 4,861,350 | A | 8/1989 | Phaal et al. | |
| 4,866,885 | A | 9/1989 | Dodsworth | |
| 4,940,180 | A | 7/1990 | Martell | |
| 4,944,772 | A | 7/1990 | Cho | |
| 4,976,324 | A | 12/1990 | Tibbitts | |
| 5,011,514 | A | 4/1991 | Cho et al. | |
| 5,027,912 | A | 7/1991 | Juergens | |
| 5,127,923 | A | 7/1992 | Bunting et al. | |
| 5,217,081 | A | 6/1993 | Waldenstrom et al. | |
| 5,443,337 | A | 8/1995 | Katayama | |
| 5,472,376 | A | 12/1995 | Olmstead et al. | |
| 5,533,582 | A | 7/1996 | Tibbitts | |
| 5,645,617 | A | 7/1997 | Frushour | |
| 5,667,028 | A | 9/1997 | Truax et al. | |
| 5,685,769 | A | 11/1997 | Adia et al. | |
| 5,722,499 | A | 3/1998 | Nguyen et al. | |
| 5,954,147 | A | 9/1999 | Overstreet et al. | |
| 5,979,577 | A | 11/1999 | Fielder | |
| 5,979,578 | A | 11/1999 | Packer | |
| 6,009,963 | A | 1/2000 | Chaves et al. | |
| 6,148,937 | A | 11/2000 | Mensa-Wilmot et al. | |
| 6,149,695 | A | 11/2000 | Adia et al. | |
| 6,187,068 | B1 | 2/2001 | Frushour et al. | |
| 6,325,165 | B1 | 12/2001 | Eyre | |
| 6,344,149 | B1 | 2/2002 | Oles | |
| 6,361,873 | B1 | 3/2002 | Yong et al. | |
| 6,719,074 | B2 | 4/2004 | Tsuda et al. | |
| 6,991,049 | B2 | 1/2006 | Eyre et al. | |
| 7,070,635 | B2 | 7/2006 | Frushour | |
| 7,074,247 | B2 | 7/2006 | Tank et al. | |
| 7,147,687 | B2 | 12/2006 | Mirkin et al. | |
| 7,435,296 | B1 | 10/2008 | Sung | |
| 7,493,973 | B2 | 2/2009 | Keshavan et al. | |
| 7,572,332 | B2 | 8/2009 | Gruen | |
| 7,585,342 | B2 | 9/2009 | Cho | |
| 7,647,992 | B2 | 1/2010 | Fang et al. | |
| 7,690,589 | B2 | 4/2010 | Kerns | |
| 7,998,573 | B2 * | 8/2011 | Qian et al. | 428/325 |
| 2004/0037948 | A1 | 2/2004 | Tank et al. | |
| 2004/0162014 | A1 | 8/2004 | John | |
| 2005/0019114 | A1 | 1/2005 | Sung | |
| 2005/0139397 | A1 | 6/2005 | Achilles et al. | |
| 2006/0113546 | A1 | 6/2006 | Sung | |
| 2006/0166615 | A1 | 7/2006 | Tank et al. | |
| 2007/0151769 | A1 * | 7/2007 | Slutz et al. | 175/426 |
| 2008/0023230 | A1 | 1/2008 | Cho | |
| 2008/0142267 | A1 | 6/2008 | Griffin et al. | |
| 2008/0149397 | A1 * | 6/2008 | Overstreet | 175/374 |
| 2008/0179109 | A1 | 7/2008 | Belnap et al. | |
| 2008/0206576 | A1 | 8/2008 | Qian et al. | |
| 2009/0022952 | A1 | 1/2009 | Keshavan | |
| 2009/0022969 | A1 | 1/2009 | Zhang et al. | |
| 2009/0038858 | A1 * | 2/2009 | Griffo et al. | 175/371 |
| 2009/0090918 | A1 | 4/2009 | Hobart et al. | |
| 2009/0127565 | A1 | 5/2009 | Sung | |
| 2009/0218146 | A1 | 9/2009 | Fang et al. | |
| 2009/0257942 | A1 | 10/2009 | Sung | |
| 2009/0277839 | A1 | 11/2009 | Linford | |
| 2009/0286352 | A1 | 11/2009 | Sung | |
| 2009/0313908 | A1 | 12/2009 | Zhang et al. | |
| 2010/0012389 | A1 | 1/2010 | Zhang et al. | |
| 2010/0014931 | A1 | 1/2010 | Matthias | |
| 2010/0068503 | A1 | 3/2010 | Neogi et al. | |
| 2010/0069567 | A1 | 3/2010 | Petrov et al. | |
| 2010/0129615 | A1 | 5/2010 | Chizik et al. | |
| 2010/0200305 | A1 | 8/2010 | Griffin et al. | |
| 2011/0036641 | A1 * | 2/2011 | Lyons | 175/432 |
| 2011/0171414 | A1 * | 7/2011 | Sreshta et al. | 428/64.1 |
| 2011/0200825 | A1 * | 8/2011 | Chakraborty et al. | 428/412 |
| 2011/0220348 | A1 * | 9/2011 | Jin et al. | 166/244.1 |
| 2011/0252713 | A1 * | 10/2011 | Chakraborty et al. | 51/298 |
| 2012/0024109 | A1 * | 2/2012 | Xu et al. | 75/243 |
| 2012/0085585 | A1 * | 4/2012 | Scott et al. | 175/428 |
| 2012/0103135 | A1 * | 5/2012 | Xu et al. | 75/233 |
| 2012/0103696 | A1 * | 5/2012 | DiGiovanni | 175/425 |
| 2012/0186885 | A1 * | 7/2012 | Scott et al. | 175/428 |
| 2012/0222364 | A1 * | 9/2012 | Lyons et al. | 51/296 |
| 2012/0292117 | A1 * | 11/2012 | John et al. | 175/428 |
| 2012/0308845 | A1 * | 12/2012 | Yun et al. | 428/635 |
| 2013/0048389 | A1 * | 2/2013 | Bao et al. | 175/428 |
| 2013/0068541 | A1 * | 3/2013 | DiGiovanni et al. | 175/434 |
| 2013/0081335 | A1 * | 4/2013 | Mazyar et al. | 51/309 |
| 2013/0108800 | A1 * | 5/2013 | Chakraborty et al. | 427/535 |
| 2013/0216777 | A1 * | 8/2013 | Jiang et al. | 428/141 |
| 2013/0299249 | A1 * | 11/2013 | Weaver et al. | 175/428 |
| 2014/0069726 | A1 * | 3/2014 | Mumma et al. | 175/432 |

FOREIGN PATENT DOCUMENTS

| | | | |
|---|---|---|---|
| EP | 0941791 | A2 | 9/1999 |
| EP | 1330323 | B1 | 10/2006 |
| EP | 2105256 | A1 | 9/2009 |
| EP | 2147903 | A2 | 1/2010 |
| WO | 0038864 | | 6/2000 |
| WO | 0234437 | | 5/2002 |
| WO | 2008014003 | | 1/2008 |
| WO | 2008092093 | | 7/2008 |
| WO | 2008094190 | | 8/2008 |
| WO | 2009118381 | | 10/2009 |
| WO | 2010062419 | | 3/2010 |

OTHER PUBLICATIONS

International Search Report for International Application No. PCT/US2011/047610 dated Mar. 22, 2012, 4 pages.

International Written Opinion for International Application No. PCT/US2011/047610 dated Mar. 22, 2012, 5 pages.

U.S. Appl. No. 61/324,142, filed Apr. 14, 2010 entitled, Method of Preparing Polycrystalline Diamond from Derivatized Nanodiamond.

DiGiovanni et al., U.S. Appl. No. 61/252,049, filed Oct. 15, 2009 entitled Polycrystalline Compacts Including Nanoparticulate Inclusions, Cutting Elements and Earth-Boring Tools Including Such Compacts, and Methods of Forming Such Compacts.

* cited by examiner

CUTTING ELEMENTS INCLUDING NANOPARTICLES IN AT LEAST ONE PORTION THEREOF, EARTH-BORING TOOLS INCLUDING SUCH CUTTING ELEMENTS, AND RELATED METHODS

CROSS-REFERENCE TO RELATED APPLICATION

This application claims the benefit of the filling date of U.S. Provisional Application Ser. No. 61/373,617, which was filed on Aug. 13, 2010, and is entitled "CUTTING ELEMENTS INCLUDING NANOPARTICLES IN AT LEAST ONE PORTION THEREOF, EARTH-BORING TOOLS INCLUDING SUCH CUTTING ELEMENTS, AND RELATED METHODS," the disclosure of which is hereby incorporated herein in its entirety by this reference.

FIELD

Embodiments of the present invention generally relate to cutting elements that include a table of superabrasive material (e.g., polycrystalline diamond or cubic boron nitride) formed on a substrate, to earth-boring tools including such cutting elements, and to methods of forming such cutting elements and earth-boring tools.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, which are cutting elements that include cutting faces of a polycrystalline diamond material. Such polycrystalline diamond cutting elements are formed by sintering and bonding together relatively small diamond grains or crystals with diamond-to-diamond bonds under conditions of high temperature and high pressure in the presence of a catalyst (such as, for example, Group VIIIA metals including, by way of example, cobalt, iron, nickel, or alloys and mixtures thereof) to form a layer or "table" of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be swept into the diamond crystals during sintering and serve as the catalyst material for forming the diamond table from the diamond crystals. In other methods, powdered catalyst material may be mixed with the diamond crystals prior to sintering the crystals together in an HTHP process.

Upon formation of a diamond table using an HTHP process, catalyst material may remain in interstitial spaces between the crystals of diamond in the resulting polycrystalline diamond table. The presence of the catalyst material in the diamond table may contribute to thermal damage in the diamond table when the cutting element is heated during use due to friction at the contact point between the cutting element and the formation. Accordingly, the polycrystalline diamond cutting element may be formed by leaching the catalyst material (e.g., cobalt) out from interstitial spaces between the diamond crystals in the diamond table using, for example, an acid or combination of acids, e.g., aqua regia. Substantially all of the catalyst material may be removed from the diamond table, or catalyst material may be removed from only a portion thereof, for example, from the cutting face, from the side of the diamond table, or both, to a desired depth.

PDC cutters are typically cylindrical in shape and have a cutting edge at the periphery of the cutting face for engaging a subterranean formation. Over time, the cutting edge becomes dull. As the cutting edge dulls, the surface area in which the cutting edge of the PDC cutter engages the formation increases due to the formation of a so-called wear flat or wear scar extending into the side wall of the diamond table. As the surface area of the diamond table engaging the formation increases, more friction-induced heat is generated between the formation and the diamond table in the area of the cutting edge. Additionally, as the cutting edge dulls, the downward force or weight on the bit (WOB) must be increased to maintain the same rate of penetration (ROP) as a sharp cutting edge. Consequently, the increase in friction-induced heat and downward force may cause chipping, spalling, cracking, or delamination of the PDC cutter due to a mismatch in coefficient of thermal expansion between the diamond crystals and the catalyst material. In addition, at temperatures of about 750° C. and above, presence of the catalyst material may cause so-called back-graphitization of the diamond crystals into elemental carbon.

Accordingly, there remains a need in the art for cutting elements that increase the durability as well as the cutting efficiency of the cutter.

BRIEF DESCRIPTION OF THE SEVERAL VIEWS OF THE DRAWINGS

While the specification concludes with claims particularly pointing out and distinctly claiming what are regarded as embodiments of the present invention, advantages of the invention may be more readily ascertained from the description of some example embodiments of the invention provided below, when read in conjunction with the accompanying drawings, in which:

DETAILED DESCRIPTION OF THE INVENTION

The illustrations presented herein are not meant to be actual views of any particular material or device, but are merely idealized representations that are employed to describe some examples of embodiments of the present invention. Additionally, elements common between figures may retain the same numerical designation.

Embodiments of the present invention include methods for fabricating cutting elements that include multiple portions or regions of relatively hard material, wherein one or more of the multiple portions or regions include nanoparticles (e.g., nanometer sized grains) therein. For example, in some embodiments, the relatively hard material may comprise polycrystalline diamond material. In some embodiments, the methods employ the use of a catalyst material to form a portion of the relatively hard material (e.g., polycrystalline diamond material).

As used herein, the term "drill bit" means and includes any type of bit or tool used for drilling during the formation or enlargement of a wellbore in a subterranean formation and includes, for example, rotary drill bits, percussion bits, core bits, eccentric bits, bicenter bits, reamers, mills, drag bits, roller cone bits, hybrid bits and other drilling bits and tools known in the art.

As used herein, the term "polycrystalline compact" means and includes any structure comprising a polycrystalline material formed by a process that involves application of pressure (e.g., compaction) to a precursor material or materials used to form the polycrystalline material.

As used herein, the term "inter-granular bond" means and includes any direct atomic bond (e.g., covalent, metallic, etc.) between atoms in adjacent grains of material.

As used herein the term "nanoparticle" means and includes any particle having an average particle diameter of about 500 nm or less.

As used herein, the term "catalyst material" refers to any material that is capable of substantially catalyzing the formation of inter-granular bonds between grains of hard material during an HTHP but at least contributes to the degradation of the inter-granular bonds and granular material under elevated temperatures, pressures, and other conditions that may be encountered in a drilling operation for forming a wellbore in a subterranean formation. For example, catalyst materials for diamond include cobalt, iron, nickel, other elements from Group VIIIA of the Periodic Table of the Elements, and alloys thereof.

Figure 1:
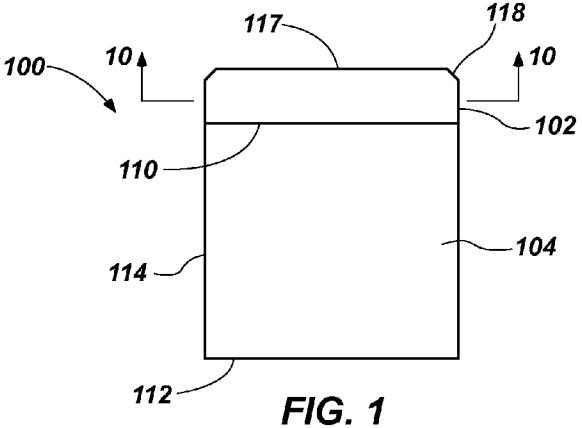
FIG. 1 illustrates an enlarged longitudinal cross-sectional view of one embodiment of a cutting element of the present invention.

FIG. 1 is a simplified cross-sectional view of an embodiment of a cutting element 100 of the present invention. The cutting element 100 may be attached to an earth-boring tool such as an earth-boring rotary drill bit (e.g., a fixed-cutter rotary drill bit). The cutting element 100 includes a multi-portion polycrystalline table or layer of hard multi-portion polycrystalline material 102 that is provided on (e.g., formed on or attached to) a supporting substrate 104. In additional embodiments, the multi-portion polycrystalline material 102 of the present invention may be formed without a supporting substrate 104, and/or may be employed without a supporting substrate 104. The multi-portion polycrystalline material 102 may be formed on the supporting substrate 104, or the multi-portion diamond table 102 and the supporting substrate 104 may be separately formed and subsequently attached together. In yet further embodiments, the multi-portion polycrystalline material 102 may be formed on the supporting substrate 104, after which the supporting substrate 104 and the multi-portion polycrystalline material 102 may be separated and removed from one another, and the multi-portion polycrystalline material 102 subsequently may be attached to another substrate that is similar to, or different from, the supporting substrate 104. The multi-portion polycrystalline material 102 includes a cutting face 117 opposite the supporting substrate 104. The multi-portion polycrystalline material 102 may also, optionally, have a chamfered edge 118 at a periphery of the cutting face 117 (e.g., along at least a portion of a peripheral edge of the cutting face 117). The chamfered edge 118 of the cutting element 100 shown in FIG. 1 has a single chamfer surface, although the chamfered edge 118 also may have additional chamfer surfaces, and such chamfer surfaces may be oriented at chamfer angles that differ from the chamfer angle of the chamfer edge 118, as known in the art. Further, in lieu of a chamfered edge 118, the edge may be rounded or comprise a combination of one or more chamfer surfaces and one or more arcuate surfaces.

The supporting substrate 104 may have a generally cylindrical shape as shown in FIG. 1. The supporting substrate 104 may have a first end surface 110, a second end surface 112, and a generally cylindrical lateral side surface 114 extending between the first end surface 110 and the second end surface 112.

Although the first end surface 110 shown in FIG. 1 is at least substantially planar, it is well known in the art to employ non-planar interface geometries between substrates and diamond tables formed thereon, and additional embodiments of the present invention may employ such non-planar interface geometries at the interface between the supporting substrate 104 and the multi-portion polycrystalline material 102. Additionally, although cutting element substrates commonly have a cylindrical shape, like the supporting substrate 104, other shapes of cutting element substrates are also known in the art, and embodiments of the present invention include cutting elements having shapes other than a generally cylindrical shape.

The supporting substrate 104 may be foamed from a material that is relatively hard and resistant to wear. For example, the supporting substrate 104 may be formed from and include a ceramic-metal composite material (which are often referred to as "cermet" materials). The supporting substrate 104 may include a cemented carbide material, such as a cemented tungsten carbide material, in which tungsten carbide particles are cemented together in a metallic matrix material. The metallic matrix material may include, for example, catalyst metal such as cobalt, nickel, iron, or alloys and mixtures thereof. Furthermore, in some embodiments, the metallic matrix material may comprise a catalyst material capable of catalyzing inter-granular bonds between grains of hard material in the multi-portion polycrystalline material 102.

In some embodiments, the cutting element 100 may be functionally graded between the supporting substrate 104 and the multi-portion polycrystalline material 102. Thus, an end of the supporting substrate 104 proximate the multi-portion polycrystalline material 102 may include at least some material of the multi-portion polycrystalline material 102 interspersed among the material of the supporting substrate 104. Likewise, an end of the multi-portion polycrystalline material 102 may include at least some material of the supporting substrate 104 interspersed among the material of the multi-portion polycrystalline material 102. For example, the end of the supporting substrate 104 proximate the multi-portion polycrystalline material 102 may include at least 1% by volume, at least 5% by volume, or at least 10% by volume of the material of the multi-portion polycrystalline material 102 interspersed among the material of the supporting substrate 104. As a continuing example, the end of the multi-portion polycrystalline material 102 proximate the supporting substrate 104 may include at least 1% by volume, at least 5% by volume, or at least 10% by volume of the material of the supporting substrate 104 interspersed among the material of the multi-portion polycrystalline material 102. As a specific, nonlimiting example, the end of a supporting substrate 104 comprising tungsten carbide particles in a cobalt matrix proximate a multi-portion polycrystalline material 102 comprising polycrystalline diamond may include 25% by volume of diamond particles interspersed among the tungsten carbide particles and cobalt matrix and the end of the multi-portion polycrystalline material 102 may include 25% by volume of tungsten carbide particles and cobalt matrix interspersed among the inter-bonded diamond particles. Thus, functionally grading the material of the cutting element 100 may provide a gradual transition from the material of the multi-portion polycrystalline material 102 to the material of the supporting substrate 104. By functionally grading the material proximate the interface between the multi-portion polycrystalline material 102 and the supporting substrate 104, the strength of the attachment between the multi-portion polycrystalline material 102 and the supporting substrate 104 may be increased relative to a cutting element 100 that includes no functional grading.

Figure 2:
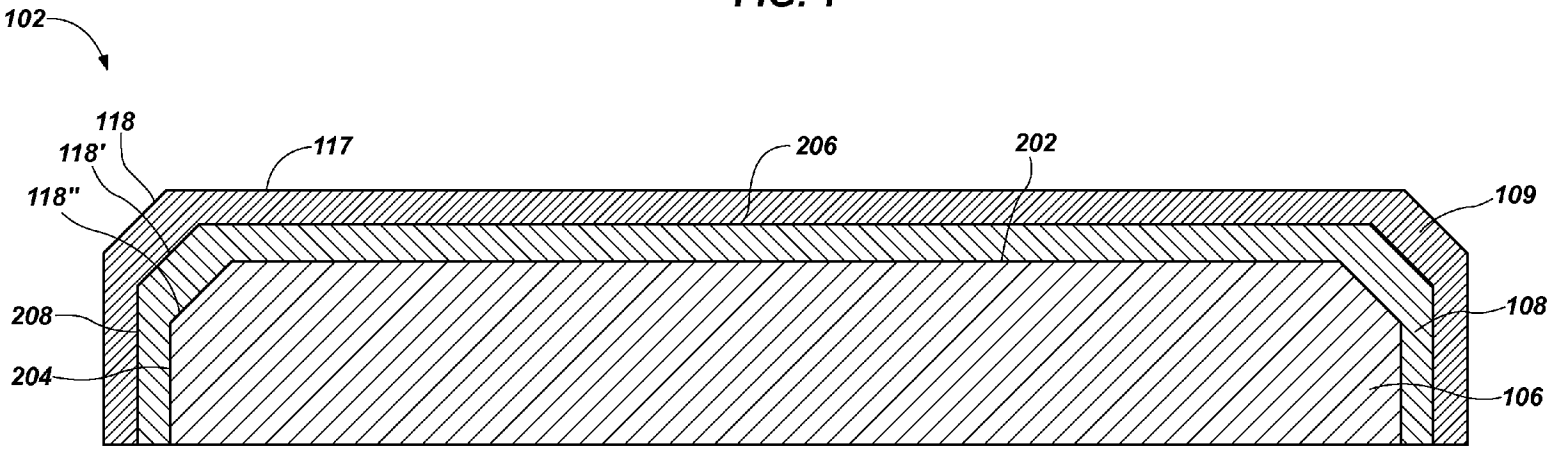
FIG. 2 illustrates an enlarged longitudinal cross-sectional view of one embodiment of a multi-portion polycrystalline material of the present invention.

FIG. 2 is an enlarged cross-sectional view of one embodiment of the multi-portion polycrystalline material 102 of FIG. 1. The multi-portion polycrystalline material 102 may comprise at least two portions. For example, as shown in FIG. 2, the multi-portion diamond table 102 includes a first portion 106, a second portion 108, and a third portion 109 as discussed in further detail below. The multi-portion polycrystalline material 102 is primarily comprised of a hard or superabrasive material. In other words, hard or superabrasive material may comprise at least about seventy percent (70%) by volume of the multi-portion polycrystalline material 102. In some embodiments, the multi-portion polycrystalline material 102 includes grains or crystals of diamond that are bonded together (e.g., directly bonded together) to form the multi-portion polycrystalline material 102. Interstitial regions or spaces between the diamond grains may be void or may be filled with additional material or materials, as discussed below. Other hard materials that may be used to form the multi-portion polycrystalline material 102 include polycrystalline cubic boron nitride, silicon nitride, silicon carbide, titanium carbide, tungsten carbide, tantalum carbide, or another hard material.

At least one portion 106, 108, 109 of the multi-portion polycrystalline material 102 comprises a plurality of grains that are nanoparticles. As previously discussed, the nanoparticles may comprise, for example, at least one of diamond, polycrystalline cubic boron nitride, silicon nitride, silicon carbide, titanium carbide, tungsten carbide, tantalum carbide, or another hard material. The nanoparticles may not be hard particles in some embodiments of the invention. For example, the nanoparticles may comprise one or more of carbides, ceramics, oxides, intermetallics, clays, minerals, glasses, elemental constituents, various forms of carbon, such as carbon nanotubes, fullerenes, adamantanes, graphene, amorphous carbon, etc. Furthermore, in some embodiments, the nanoparticles may comprise a carbon allotrope and may have an average aspect ratio of about one hundred (100) or less.

The at least one portion 106, 108, 109 comprising nanoparticles may comprise about 0.01% to about 99% by volume or weight nanoparticles. More specifically, at least one of the first, second, and third portions 106, 108, and 109 may comprise between about 5% and about 80% by volume nanoparticles. Still more specifically, at least one of the first, second, and third portions 106, 108, and 109 may comprise between about 25% and about 75% by volume nanoparticles. Each portion 106, 108, 109 of the multi-portion polycrystalline material 102 may have an average grain size differing from an average grain size in another portion of the multi-portion polycrystalline material 102. In other words, the first portion 106 comprises a plurality of grains of hard material having a first average grain size, the second portion 108 comprises a plurality of grains of hard material having a second average grain size that differs from the first average grain size, and the third portion 109 comprises a plurality of grains of hard material having a third average grain size that differs from the first average grain size and the second average grain size. The one or more portions 106, 108, 109 that comprise nanoparticles optionally may include additional grains or particles that are not nanoparticles. In other words, such portions may include a first plurality of particles, which may be referred to as primary particles, and the nanoparticles may comprise secondary particles that are disposed in interstitial spaces between the primary particles. The primary particles may comprise grains having an average grain size greater than about 500 nanometers. In some embodiments, each of the first portion 106, the second portion 108, and the third portion 109 may comprise a volume of polycrystalline material that includes mixtures of grains or particles as described in provisional U.S. patent application Ser. No. 61/252,049, which was filed Oct. 15, 2009, and entitled "Polycrystalline Compacts Including Nanoparticulate Inclusions, Cutting Elements and Earth-Boring Tools Including Such Compacts, and Methods of Forming Such Compacts," the disclosure of which is incorporated herein in its entirety by this reference, but wherein at least two of the first portion 106, the second portion 108, and the third portion 109 differ in one or more characteristics relating to grain size and/or distribution.

In one embodiment, as shown in FIG. 2 the first portion 106 may be formed adjacent the supporting substrate 104 (FIG. 1) along the surface 110, the second portion 108 may be formed over the first portion 106 on a side thereof opposite the supporting substrate 104, and the third portion 109 may be formed over the second portion 108 on a side thereof opposite the first portion 106. In other words, the second portion 108 may be disposed between the first portion 106 and the third portion 109. The third portion 109, which includes the cutting face 117 of the multi-portion diamond table 102, may comprise the nanoparticles of hard material. In one non-limiting embodiment, the first portion 106 may not have any nanoparticles, the second portion 108 may comprise between five and ten volume percent nanoparticles having a 200 nm average cluster size, the third portion 109 may comprise between five and ten volume percent nanoparticles having a 75 nm average cluster size. In another non-limiting embodiment, the first portion 106 may comprise between five and ten volume percent nanoparticles having a 400 nm average cluster size, the second portion 108 may comprise between five and ten volume percent nanoparticles having a 200 nm average cluster size, and the third portion 109 may comprise between five and ten volume percent nanoparticle having a 75 nm average cluster size.

In some embodiments, the multi-portion polycrystalline material 102 may include portions comprising nanoparticles adjacent other portions lacking nanoparticles. For example, alternating layers of the multi-portion polycrystalline material 102 may selectively include and exclude nanoparticles from the material thereof. As a specific, nonlimiting example, the third portion 109 including the cutting face 117 of the multi-portion polycrystalline material 102 and the first portion 106 adjacent the supporting substrate 104 (see FIG. 1) may include at least some nanoparticles, while the second portion 108 interposed between the first portion 106 and the third portion 109 may be devoid of nanoparticles.

In embodiments where a portion comprising nanoparticles is located adjacent another portion having a comparatively smaller quantity of nanoparticles or being at least substantially free of nanoparticles, the portions may be functionally graded between one another. For example, a region of a portion including nanoparticles (e.g., third portion 109) proximate another portion having a comparatively smaller quantity of nanoparticles or being at least substantially free of nanoparticles (e.g., second portion 108) may comprise a volume of nanoparticles that is intermediate (i.e., between) the overall volumes of nanoparticles in the portion including nanoparticles (e.g., third portion 109) and the other portion having the comparatively smaller quantity of nanoparticles or being at least substantially free of nanoparticles. Alternatively or in addition, a region of a portion having a comparatively smaller quantity of nanoparticles or being at least substantially free of nanoparticles (e.g., second portion 108) proximate a portion including nanoparticles (e.g., third portion 109) may comprise a volume of nanoparticles that is intermediate (i.e., between) the overall volumes of nanoparticles in the portion having the comparatively smaller quantity of nanoparticles or being at least substantially free of nanoparticles (e.g., second portion 108) and the portion including nanoparticles (e.g., third portion 109). Thus, an end of a portion (e.g., third portion 109) including nanoparticles proximate another portion (e.g., second portion 108) generally lacking nanoparticles may include a reduced volume percentage of nanoparticles as compared to an overall volume percentage of nanoparticles in the portion. Likewise, an end of a portion (e.g., second portion 108) generally lacking nanoparticles proximate another portion (e.g., third portion 109) including nanoparticles may include at least some nanoparticles. For example, the end of a third portion 109 including nanoparticles proximate a second portion 108 generally lacking nanoparticles may include a volume percentage of nanoparticles that is 1% by volume, 5% by volume, or even 10% by volume less than an overall volume percentage of nanoparticles in the third portion 109. As a continuing example, the end of a second portion 108 generally lacking nanoparticles proximate a first portion 109 including nanoparticles may include at least 1% by volume, at least 5% by volume, or at least 10% by volume nanoparticles, while a remainder of the second portion 108 may be devoid of nanoparticles. As a specific, nonlimiting example, the end of a third portion 109 comprising nanoparticles proximate a second portion 108 generally lacking nanoparticles may include a volume percentage of nanoparticles that is 3% smaller than an overall volume percentage of nanoparticles in the third portion 109 and the end of the second portion 108 proximate the third portion 109 may include 3% by volume nanoparticles, while the remainder of the second portion 108 may be devoid of nanoparticles.

In some embodiments, the multi-portion polycrystalline material 102 may be functionally graded between a portion including nanoparticles (e.g., third portion 109) and another portion (e.g., second portion 108) either having a comparatively smaller quantity of nanoparticles or being at least substantially free of nanoparticles by providing layers that gradually vary the quantity of nanoparticles between the portions (e.g., between the second and third portions 108 and 109). For example, the quantity of nanoparticles in layers of a portion including nanoparticles (e.g., third portion 109) proximate the interface between the portion (e.g., third portion 109) and another portion either having a comparatively smaller quantity of nanoparticles or generally lacking nanoparticles (e.g., second portion 108) may gradually decrease as distance from the interface decreases. More specifically, a series of layers having incrementally smaller volume percentages of nanoparticles, for example, may be provided as a region of the portion comprising nanoparticles (e.g., third portion 109) proximate the portion either having a comparatively smaller quantity of nanoparticles or being at least substantially free of nanoparticles (e.g., second portion 108). As a continuing example, the quantity of nanoparticles in layers of a portion either having a comparatively smaller quantity of nanoparticles or generally lacking nanoparticles (e.g., second portion 108) proximate the interface between the portion (e.g., second portion 108) and another portion having an higher quantity of nanoparticles (e.g., third portion 109) may gradually increase as distance from the interface decreases. More specifically, a series of layers having incrementally larger volume percentages of nanoparticles, for example, may be provided as a region of the portion either having a comparatively smaller quantity of nanoparticles or being generally free of nanoparticles (e.g., second portion 108) proximate the portion having a comparatively larger quantity of nanoparticles (e.g., third portion 109).

In some embodiments, the transition between the quantities of nanoparticles in adjacent portions (e.g., second and third portions 108 and 109) may be so gradual that no distinct boundary between the portions is discernible, there being an at least substantially continuous gradient in volume percentage of nanoparticles. Furthermore, the gradient may continue throughout some or all of the multi-portion polycrystalline material 102 in some embodiments such that an at least substantially continuous or gradual change in the quantity of nanoparticles may be observed, there being no distinct boundary between the disparate portions of the multi-portion polycrystalline material 102. Thus, functionally grading the quantities of nanoparticles may provide a gradual transition between the portions of the multi-portion polycrystalline material 102. By functionally grading the material proximate the interface between portions of the multi-portion polycrystalline material 102, the strength of the attachment between the portions may be increased relative to a multi-portion polycrystalline material 102 that includes no functional grading.

Figure 3:
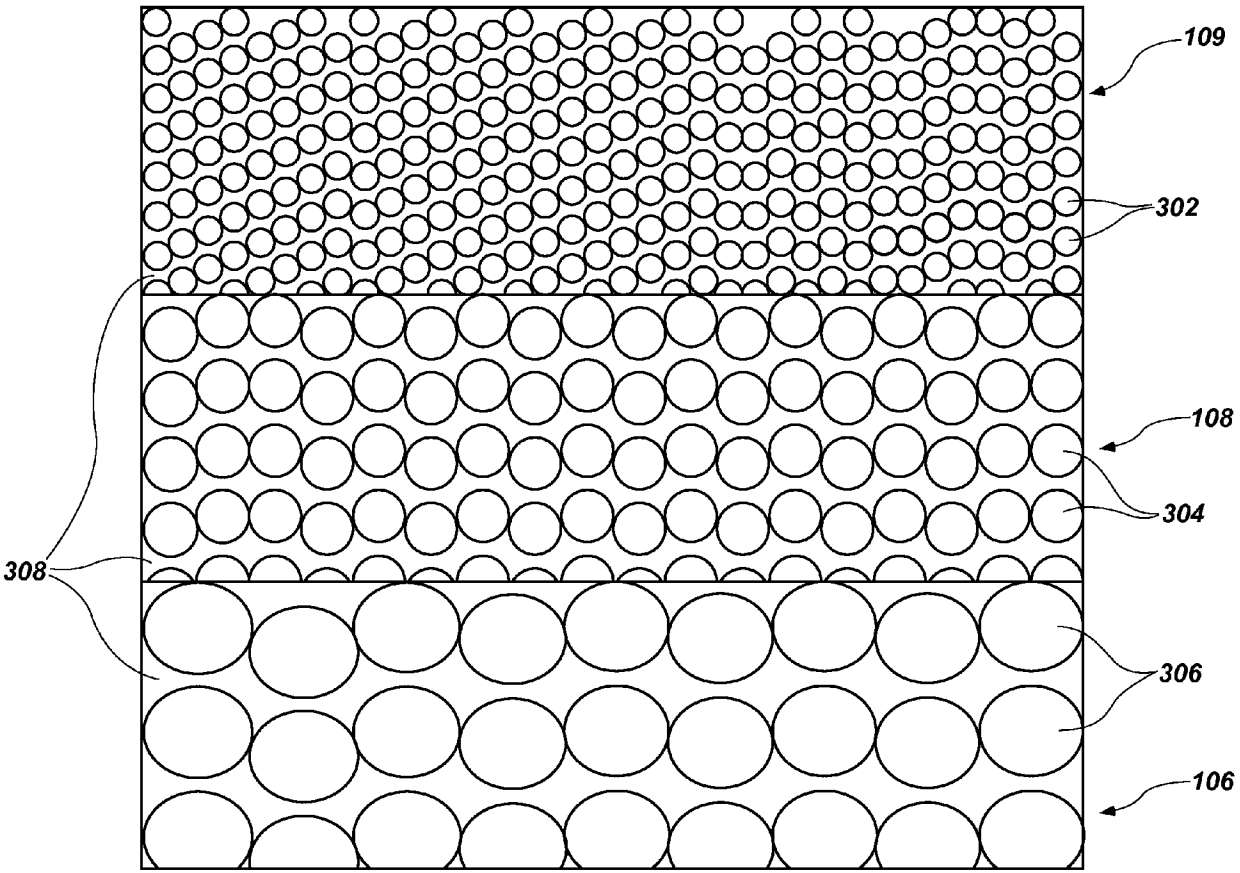
FIG. 3 is a simplified figure illustrating how a microstructure of the multi-portion polycrystalline material of FIG. 2 may appear under magnification.

FIG. 3 is an enlarged simplified view of a microstructure of one embodiment of the multi-portion polycrystalline material 102. While FIG. 3 illustrates the plurality of grains 302, 304, 306 as having differing average grain sizes, the drawing is not drawn to scale and has been simplified for the purposes of illustration. As shown in FIG. 3, the third portion 109 comprises a third plurality of grains 302, which have a smaller average grain size than both an average grain size of a second plurality of grains 304 in the second portion 108 and an average grain size of a first plurality of grains 306 in the first portion 106. The third plurality of grains 302 may comprise nanoparticles. The second plurality of grains 304 in the second portion 108 may have an average grain size greater than the average grain size of the third plurality of grains 302 in the third portion 109. Similarly, the first plurality of grains 306 in the first portion 106 may have an average size greater than the average grain size of the second plurality of grains 304 in the second portion 108. In some embodiments, the average grain size of the second plurality of grains 304 in the second portion 108 may be between about fifty (50) to about one thousand (1000) times greater than the average grain size of the third plurality of grains 302 in the third portion 109. The average grain size of the first plurality of grains 306 in the first portion 106 may be between about fifty (50) to about one thousand (1000) times greater than the average grain size of the second plurality of grains 304 in the second portion 108. As a nonlimiting example, the second plurality of grains 304 in the second portion 108 may have an average grain size about one hundred (100) times greater than the average grain size of the third plurality of grains 302 in the third portion 109, and the first plurality of grains 306 in the first portion 106 may have an average grain size about one hundred (100) times greater than the average grain size of the second plurality of grains 304 in the second portion 108.

The plurality of grains 302, 304, 306 in the first portion 106, the second portion 108, and the third portion 109 may be inter-bonded to foam the multi-portion polycrystalline material 102. In other words, in embodiments in which the multi-portion polycrystalline material 102 comprises polycrystalline diamond, the plurality of grains 302, 304, 306 from the first portion 106, the second portion 108, and the third portion 109 may be bonded directly to one another by inter-granular diamond-to-diamond bonds.

In some embodiments, the plurality of grains 302, 304, 306 in each of the portions 106, 108, 109 of the multi-portion polycrystalline material 102 may have a multi-modal (e.g., bi-modal, tri-modal, etc.) grain size distribution. For example, in some embodiments, the second portion 108 and the first portion 106 of the multi-portion polycrystalline material 102 may also comprise nanoparticles, but in lesser volumes than the third portion 109 such that the average grain size of the plurality of grains 304 in the second portion 108 is larger than the average grain size of the plurality of grains 302 in the third portion 109, and the average grain size of the plurality of grains 306 in the first portion 106 is larger than the average grain size of the plurality of grains 304 in the second portion 108. For example, in one embodiment, the third portion 109 may comprise at least about 25% by volume nanoparticles, the second portion 108 may comprise about 5% by volume nanoparticles, and the first portion 106 may comprise about 1% by volume nanoparticles.

As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of the multi-portion polycrystalline material 102 (e.g., a polished and etched surface of the multi-portion polycrystalline material 102) or a suitably prepared section of the surface in the case of TEM as known in the art. Commercially available vision systems or image analysis software are often used with such microscopy tools, and these vision systems are capable of measuring the average grain size of grains within a microstructure.

In some embodiments, one or more regions of the multi-portion polycrystalline material 102 (e.g., the diamond table 102 of FIG. 1), or the entire volume of the multi-portion polycrystalline material 102, may be processed (e.g., etched) to remove metal material (e.g., such as a metal catalyst used to catalyze the formation of direct inter-granular bonds between grains of hard material in the multi-portion polycrystalline material 102) from between the inter-bonded grains of hard material in the multi-portion polycrystalline material 102. As a particular non-limiting example, in embodiments in which the multi-portion polycrystalline material 102 comprises polycrystalline diamond material, metal catalyst material may be removed from between the inter-bonded grains of diamond within the polycrystalline diamond material, such that the polycrystalline diamond material is relatively more thermally stable.

A material 308 may be disposed in interstitial regions or spaces between the plurality of grains 302, 304, 306 in each portion 106, 108, 109. In some embodiments, the material 308 may comprise a catalyst material that catalyzes the formation of the inter-granular bonds directly between grains 302, 304, 306 of hard material during formation of the multi-portion polycrystalline material 102. In additional embodiments, the multi-portion polycrystalline material 102 may be processed to remove the material 308 from the interstitial regions or spaces between the plurality of grains 302, 304, 306 leaving voids therebetween, as mentioned above. Optionally, in such embodiments, such voids may be subsequently filled with another material (e.g., a metal). In embodiments in which the material 308 comprises a catalyst material, the material 308 may also include particulate (e.g., nanoparticles) inclusions of non-catalyst material, which may be used to reduce the amount of catalyst material within the multi-portion polycrystalline material 102.

Referring again to FIG. 2, the first portion 106 may be formed to have a region boundary 118" that is substantially parallel to the chamfered edge 118. The second portion 108 may be formed over the first portion 106 extending along a top surface 202 and sides 204 of the first portion 106. The second portion 108 may also be formed to include a region boundary 118' that is substantially parallel to the chamfered edge 118. The third portion 109 may be formed over the second portion 108 extending along a top surface 206 and around sides 208 of the second portion 108. The third portion 109 forms the cutting face 117 and the chamfered edge 118 of the multi-portion polycrystalline material 102.

Figure 4:
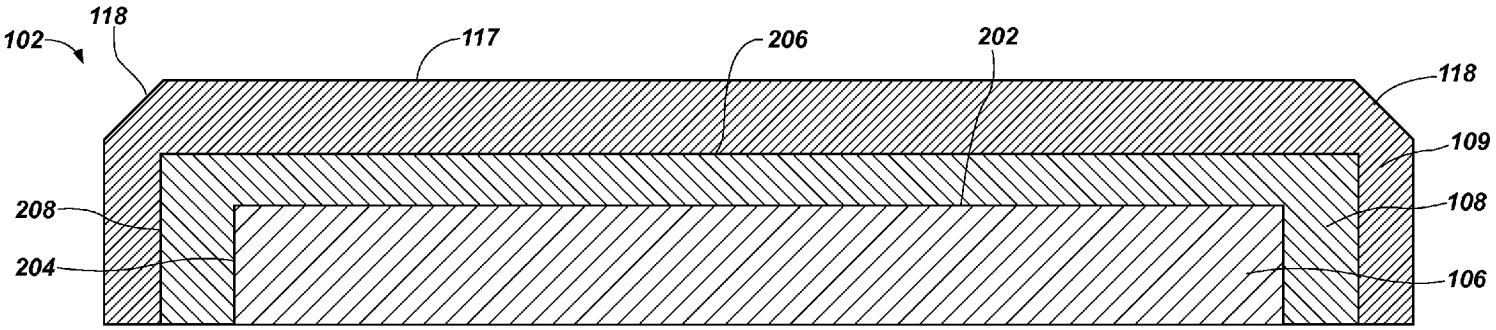
FIGS. 4-9 illustrate additional embodiments of enlarged longitudinal cross-sectional views of a multi-portion polycrystalline material of the present invention.

In another embodiment, as shown in FIG. 4, the first portion 106 and the second portion 108 may be formed without the regional boundaries 118", 118' of FIG. 2. The top surface 202 of the first portion 106 and the sides 204 of the first portion 106 may intersect at a right angle to one another. Similarly, the top surface 206 and the sides 208 of the second portion 108, formed over the first portion 106, may intersect at a right angle to one another. The third portion 109 may be formed over the second portion 108 and include the chamfered edge 118 and front cutting face 117 of the multi-portion polycrystalline material 102.

Figure 5:
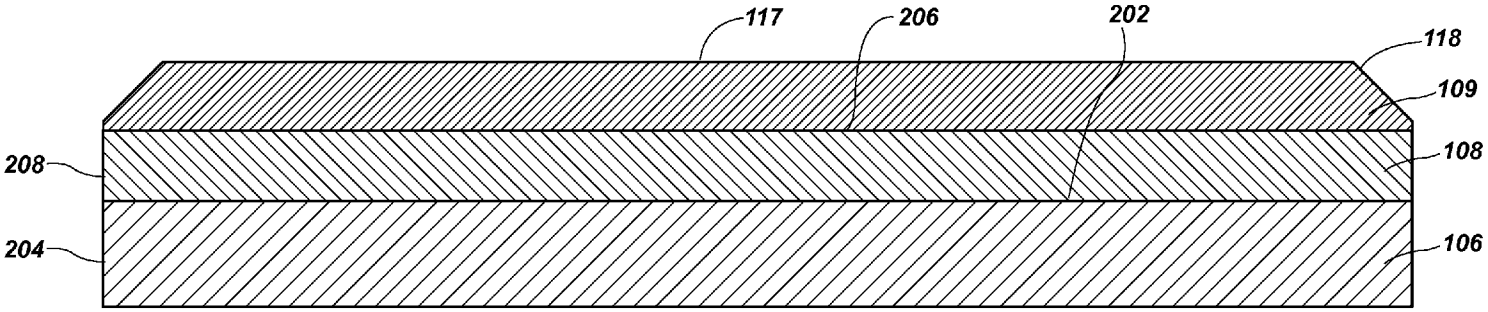

In another embodiment, as shown in FIG. 5, each of the first portion 106 and the second portion 108 may be substantially planar, and the second portion 108 may not extend down a lateral side of the first portion 106, as it does in the embodiments of FIGS. 2 and 4. As shown in FIG. 5, the second portion 108 may be formed over the top surface 202 of the first portion 106 and the third portion 109 may be formed over the top surface 206 of the second portion 108. The sides 204 of the first portion 106 and the sides 208 of the second portion 108 may be exposed to the exterior of the multi-portion polycrystalline material 102. The third portion 109 includes the front cutting face 117 and the chamfered edge 118.

Figure 6:
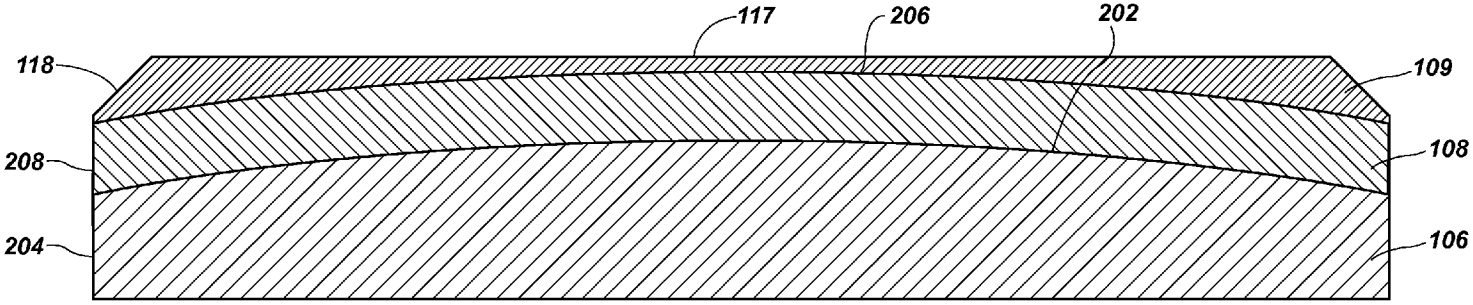

FIG. 6 illustrates another embodiment of the multi-portion polycrystalline material 102. As illustrated in FIG. 6, the second portion 108 may be formed over the top surface 202 of the first portion 106 and the third portion 109 may be formed over the top surface 206 of the second portion 108. The sides 204 of the first portion 106 and the sides 208 of the second portion 108 may be exposed to the exterior of the multi-portion polycrystalline material 102. The third portion 109 includes the front cutting face 117 and the chamfered edge 118. The top surface 202 of the first portion 106 and the top surface 206 of the second portion 108 are not planar, and the interfaces between the first portion 106, the second portion 108, and the third portion 109 are accordingly non-planar. As shown in FIG. 6, the top surface 202 of the first portion 106 and the top surface 206 of the second portion 108 are convexly curved. In additional embodiments, the top surface 202 of the first portion 106 and the top surface 206 of the second portion 108 may be concavely curved. In yet further embodiments, the top surface 202 of the first portion 106 and the top surface 206 of the second portion 108 may include other non-planar shapes.

Figure 7:
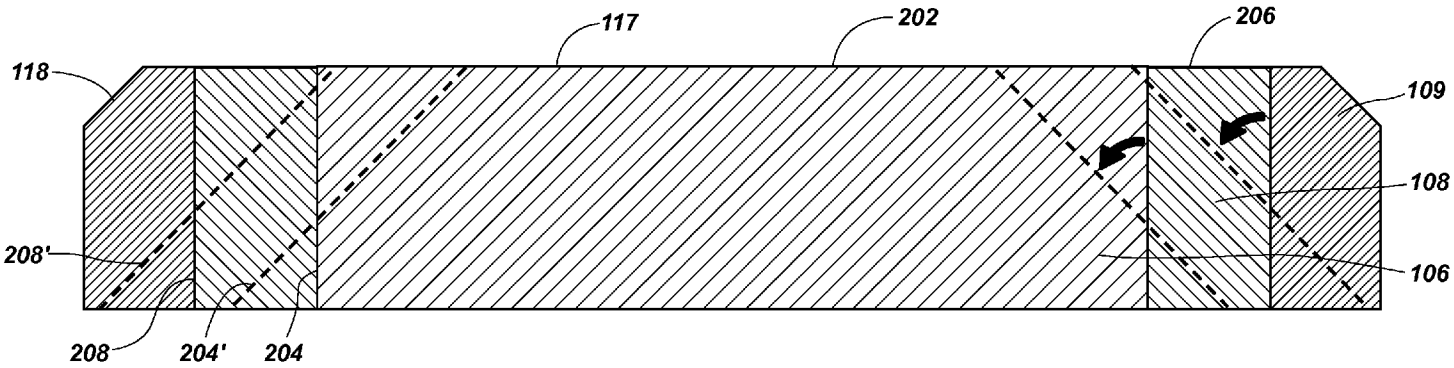

In another embodiment, as shown in FIG. 7, the second portion 108 may be formed on the lateral sides 204 of the first portion 106 and the third portion 109 may be formed on the lateral sides 208 of the second portion 108. The top surface 202 of the first portion 106 and the top surface 206 of the second portion 108 may be exposed to the exterior of the multi-portion polycrystalline material 102 and form portions of the cutting face 117. In such embodiments, the second portion 108 and the first portion 106 may comprise concentric annular regions. In an additional embodiment, the sides 204 of the first portion 106 may be angled as shown, for example, by dashed line 204'. In other words, the lateral side surface of the first portion 106 may have a frustoconical shape. Similarly, the sides 208 of the second portion 108 may be angled as shown, for example, by dashed line 208'. In other words, the lateral side surface of the second portion 108 also may have a frustoconical shape. The second portion 108 may be formed on the sides 204' of the first portion 106 and the third portion 109 may be funned on the sides 208' of the second portion 108. The top surface 202 of the first portion 106 and the top surface 206 of the second portion 108 may be exposed to the exterior of the polycrystalline multi-portion material 102, and may form at least a portion of the front cutting face 117.

Figure 8:
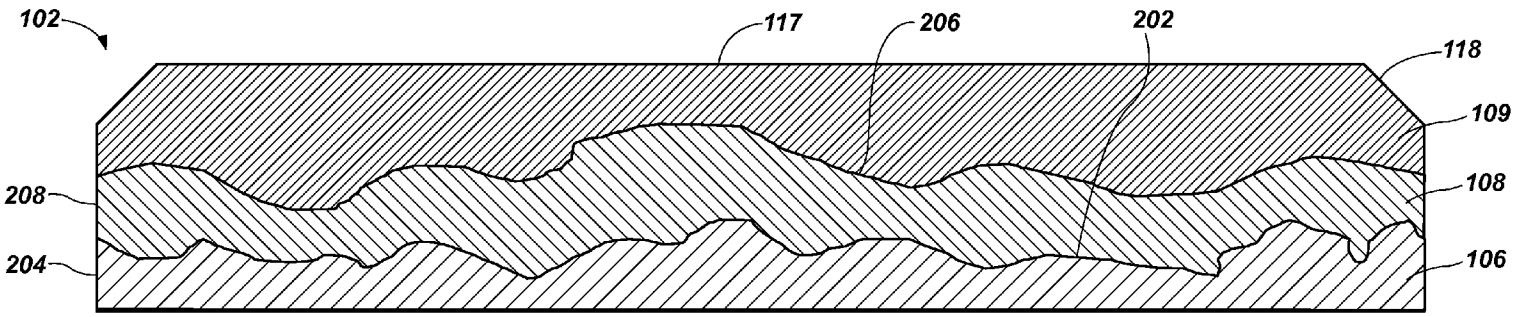
Figure 9:
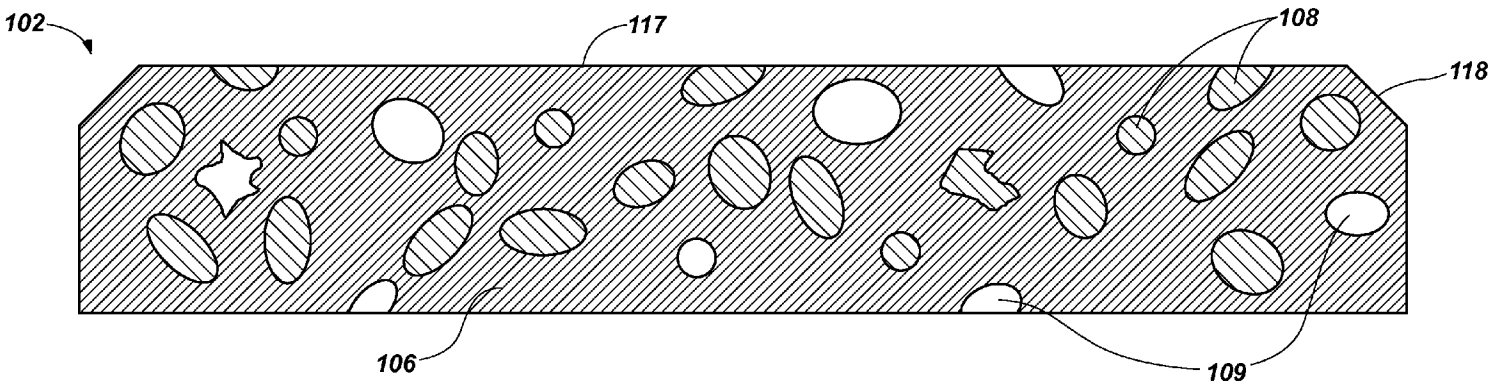

In further embodiments, as shown in FIG. 8, the first portion 106, the second portion 108, and the third portion 109 may have generally randomly shaped boundaries therebetween. In such embodiments, as shown in FIG. 8, the top surface 202 of the first portion 106 and the top surface 206 of the second portion 108 may be uneven. In still further embodiments, as shown in FIG. 9, the first portion 106, the second portion 108, and the third portion 109 may be inter mixed throughout the multi-portion polycrystalline material 102. In other words, each of the second portion 108 and the third portion 109 may occupy a number of finite, three-dimensional, interspersed volumes of space within the first portion 106, as shown in FIG. 9.

Figure 10A:
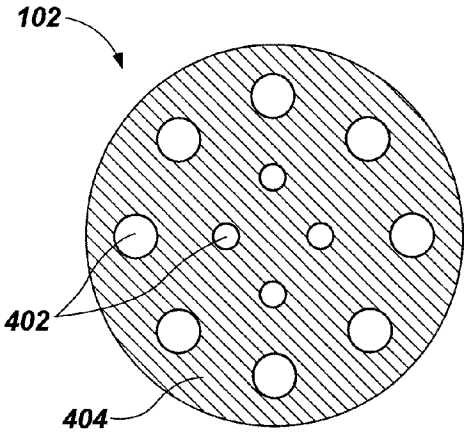
FIGS. 10A-10K are enlarged latitudinal cross-sectional views of embodiments of a multi-portion polycrystalline material of the present invention.

FIGS. 10A-10K are enlarged transverse cross-sectional views of additional embodiments of the multi-portion diamond table 102 of FIG. 1 taken along the plane illustrated by section line 10-10 in FIG. 1. As shown in FIG. 10A, the multi-portion diamond table 102 includes at least two portions, such as a first portion 402 and a second portion 404. At least one portion of the at least two portions 402 and 404 comprises a plurality of grains that are nanoparticles. In other words, the average grain size of a plurality of grains (but not necessarily all grains) in at least one of the two portions 402 and 404 may be about 500 nanometers or less. The at least one portion 402, 404 comprising nanoparticles may comprise about 0.01% to about 99% by volume nanoparticles. The first portion 402 comprises a different concentration of nanoparticles than the second portion 404. In some embodiments, the first portion 402 may comprise a higher concentration of nanoparticles than the second portion 404. Alternatively, in additional embodiments, the first portion 402 may comprise a lower concentration of nanoparticles than the second portion 404. The portion 402, 404 having the lower concentration of nanoparticles may not comprise any nanoparticles in some embodiments. Each portion of the at least two portions 402, 404 may independently comprise a mono-modal, mixed modal, or random size distribution of grains.

Figure 10B:
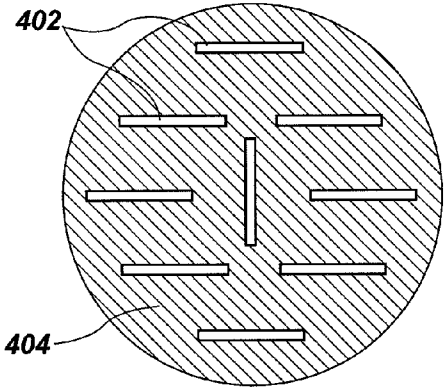
Figure 10C:
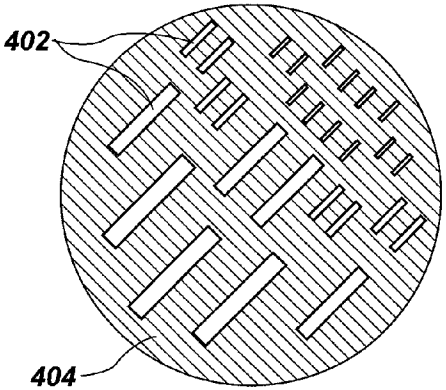
Figure 10D:
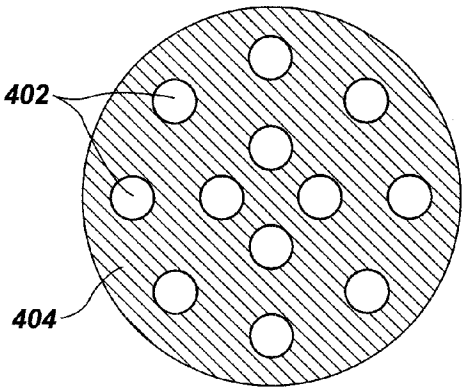
Figure 10E:
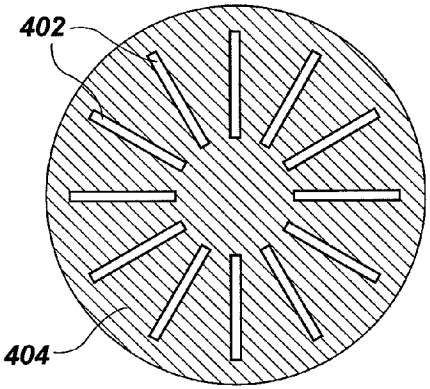
Figure 10F:
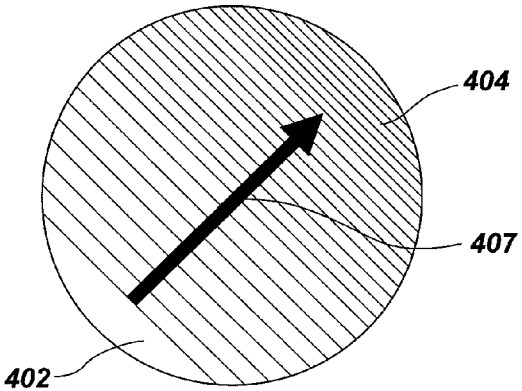
Figure 10I:
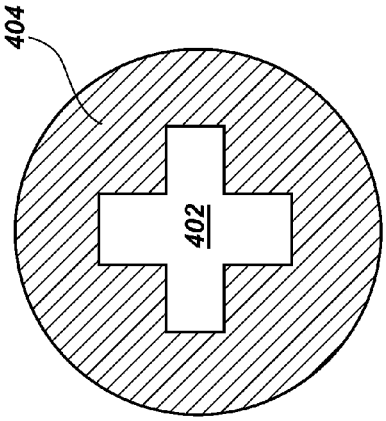
Figure 10H:
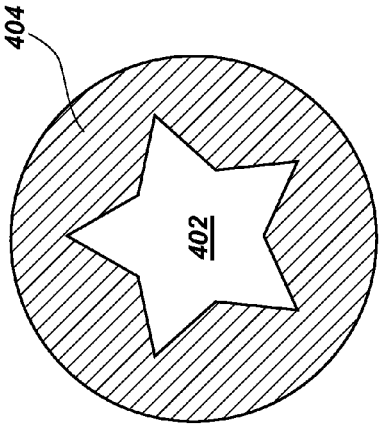
Figure 10K:
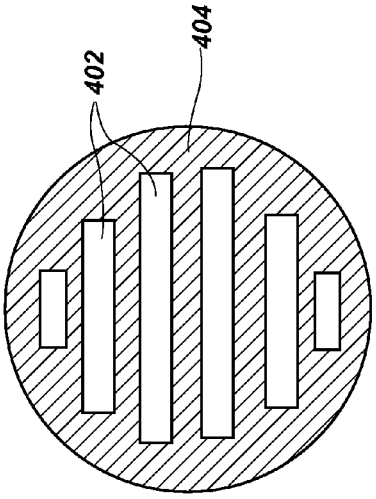
Figure 10G:
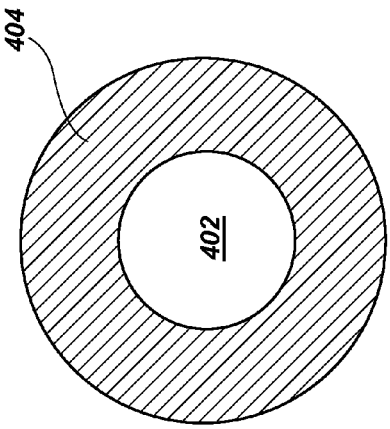
Figure 10J:
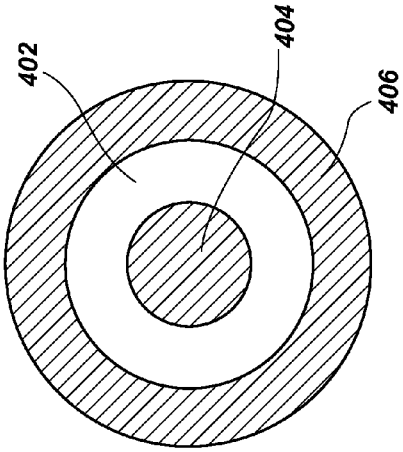

The first portion 402 may occupy a volume of space within the multi-portion polycrystalline material 102, the volume having any of a number of shapes. In some embodiments, the first portion 402 may occupy a plurality of discrete volumes of space within the second portion 404, and the plurality of discrete volumes of space may be selectively located and oriented at predetermined locations and orientations (e.g., in an ordered array) within the second portion 404, or they may be randomly located and oriented within the second portion 404. For example, the first portion 402 may have the shape of one or more of spheres, ellipses, rods, platelets, rings, toroids, stars, n-sided or irregular polygons, snowflake-type shapes, crosses, spirals, etc. As shown in FIG. 10A, the first portion 402 may include a plurality different sized spheres dispersed throughout the second portion 404. As shown in FIG. 10B, the first portion 402 may include a plurality of rods dispersed throughout the second portion 404. As shown in FIG. 10C, the first portion may comprise a plurality of different sized rods dispersed throughout the second portion 404. As shown in FIG. 10D, the first portion 402 may comprise a plurality of similarly shaped spheres dispersed throughout the second portion 404. As shown in FIG. 10E, the first portion 402 may comprise a plurality of rods extending radially outward from a center of the multi-portion polycrystalline material 102, and dispersed within the second portion 402. As shown in FIG. 10F, there may not be a definite, discrete boundary between the first portion 402 and the second portion 404, but rather the first portion 402 may gradually transform into the second portion 404 along the direction illustrated by the arrow 407. In other words, a gradual gradient in the concentration of nanoparticles and other grains may exist between the first portion 402 and the second portion 404. As shown in FIG. 10G, the first portion 402 may comprise a center region of the multi-portion polycrystalline material 102, and the second portion 404 may comprise an outer region of the multi-portion polycrystalline material 102. As shown in FIG. 10H, the first portion 402 may comprise a star-shaped volume of space surrounded by the second portion 404. As shown in FIG. 10I, the first portion 402 may comprise a cross-shaped volume of space surrounded by the second portion 404. As shown in FIG. 10J, the first portion 402 may comprise an annular or ring-shaped volume of space having the second portion 404 on an interior of the ring. A third portion 406 may be formed on an exterior portion of the ring. The third portion 406 may have the same or a different concentration of nanoparticles as the second portion 404. As shown in FIG. 10K, the first portion 402 may comprise a plurality of parallel rod-shaped volumes of space dispersed throughout the second portion 404. In embodiments in which the first portion 402 includes more than one region, such as the plurality of spheres shown in FIG. 10A, the spacing between each region of the first portion 402 may be uniform or stochastic and the first portion 402 may be homogeneous or heterogeneous throughout the second portion 404.

In some embodiments, the multi-portion polycrystalline material 102 may include nanoparticles in at least one layered portion 106, 108, 109 of the multi-portion polycrystalline material 102 as shown in FIGS. 2-9 and nanoparticles in at least one discrete portion 402 of the multi-portion polycrystalline material 102 as shown in FIGS. 10A-10K. Including nanoparticles in at least one portion 106, 108, 109, 402, 404 of the multi-portion polycrystalline material 102 may increase the thermal stability and durability of the multi-portion polycrystalline material 102. For example, the nanoparticles in the at least one portion 106, 108, 109, 402, 404 may inhibit large cracks or chips from rimming in the multi-portion polycrystalline material 102 during use in cutting formation material using the multi-portion polycrystalline material 102, such as on a cutting element of an earth-boring tool.

The multi-portion polycrystalline material 102 of the cutting element 100 may be formed using a high temperature/high pressure (or "HTHP") process. Such processes, and systems for carrying out such processes, are generally known in the art. In some embodiments of the present invention, the nanoparticles used to form at least one portion 106, 108, 109, 402, 404 of the multi-portion polycrystalline material 102 may be coated, metalized, functionalized, or derivatized to include functional groups. Derivatizing the nanoparticles may hinder or prevent agglomeration of the nanoparticles during formation of the multi-portion polycrystalline material 102. Such methods of forming derivatized nanoparticles are described in U.S. Provisional Patent Application No. 61/324,142 filed Apr. 14, 2010 and entitled "Method of Preparing Polycrystalline Diamond From Derivatized Nanodiamond," the disclosure of which provisional patent application is incorporated herein in its entirety by this reference.

In some embodiments, the multi-portion polycrystalline material 102 may be formed on a supporting substrate 104 (as shown in FIG. 1) of cemented tungsten carbide or another suitable substrate material in a conventional HTHP process of the type described, by way of non-limiting example, in U.S. Pat. No. 3,745,623 to Wentorf et al. (issued Jul. 17, 1973), or may be formed as a freestanding polycrystalline compact (i.e., without the supporting substrate 104) in a similar conventional HTHP process as described, by way of non-limiting example, in U.S. Pat. No. 5,127,923 to Bunting et al. (issued Jul. 7, 1992), the disclosure of each of which patents is incorporated herein in its entirety by this reference. In some embodiments, a catalyst material may be supplied from the supporting substrate 104 during an HTHP process used to form the multi-portion polycrystalline material 102. For example, the supporting substrate 104 may comprise a cobalt-cemented tungsten carbide material. The cobalt of the cobalt-cemented tungsten carbide may serve as the catalyst material during the HTHP process.

To form the multi-portion polycrystalline material 102 in an HTHP process, a particulate mixture comprising grains of hard material, including nanoparticles of the hard material, may be subjected to elevated temperatures (e.g., temperatures greater than about 1,000° C.) and elevated pressures (e.g., pressures greater than about 5.0 gigapascals (GPa)) to form inter-granular bonds between the grains, thereby forming the multi-portion polycrystalline material 102. A particulate mixture comprising the desired grain size for each portion 106, 108, 109, 402, 404 may be provided on the supporting substrate 104 in the desired location of each portion 106, 108, 109, 402, 404 prior to the HTHP process.

The particulate mixture may comprise the nanoparticles as previously described herein. The particulate mixture may also comprise particles of catalyst material. In some embodiments, the particulate material may comprise a powder-like substance prepared using a wet or a dry process, such as those known in the art. In other embodiments, however, the particulate material may be processed into the form of a tape or film, as described in, for example, U.S. Pat. No. 4,353,958, which issued Oct. 12, 1982 to Kita et al., or as described in U.S. Patent Application Publication No. 2004/0162014 A1, which published Aug. 19, 2004 in the name of Hendrik, the disclosure of each of which is incorporated herein in its entirety by this reference, which tape or film may be shaped, loaded into a die, and subjected to the HTHP process.

Conventionally, because nanoparticles may be tightly compacted, the catalyst material may not adequately reach interstitial spaces between all the nanoparticles in a large quantity of nanoparticles. Accordingly, the HTHP sintering process may fail to adequately form the multi-portion polycrystalline material 102. However, because embodiments of the present invention include portions 106, 108, 109, 402, 404 comprising different volumes of nanoparticles, the catalyst material may reach farther depths in the particulate mixture, thereby adequately forming the multi-portion polycrystalline material 102.

Once formed, certain regions of the multi-portion polycrystalline material 102, or the entire volume of multi-portion polycrystalline material 102, optionally may be processed (e.g., etched) to remove material (e.g., such as a metal catalyst used to catalyze the formation of inter-granular bonds between the grains of hard material) from between the inter-bonded grains of the multi-portion polycrystalline material 102, such that the polycrystalline material is relatively more thermally stable.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

CONCLUSION

In some embodiments, cutting elements comprise a multi-portion polycrystalline material. At least one portion of the multi-portion polycrystalline material comprises a higher volume of nanoparticles than at least another portion of the multi-portion polycrystalline material.

In other embodiments, earth-boring tools comprise a body and at least one cutting element attached to the body. The at least one cutting element comprises a hard polycrystalline material. The hard polycrystalline material comprises a first portion comprising a first volume of nanoparticles. A second portion of the hard polycrystalline material comprises a second volume of nanoparticles. The first volume of nanoparticles differs from the second volume of nanoparticles.

What is claimed is:

1. A cutting element for drilling subterranean formations comprising a multi-portion polycrystalline diamond material, at least one portion of the multi-portion polycrystalline diamond material comprising a higher volume of nanoparticles than at least another portion of the multi-portion polycrystalline diamond material, wherein inter-granular bonds are formed between particles of the at least one portion and particles of the at least another portion of the multi-portion polycrystalline diamond material.

2. The cutting element of claim 1, wherein the nanoparticles comprise a carbon allotrope and have an average aspect ratio of about one hundred or less.

3. The cutting element of claim 2, wherein the nanoparticles comprise at least one of diamond nanoparticles, fullerenes, carbon nanotubes, and graphene nanoparticles.

4. The cutting element of claim 1, wherein the multi-portion polycrystalline diamond material is functionally graded, a region of at least one of the at least one portion and the at least another portion proximate the other of the at least one portion and the at least another portion comprising a volume of nanoparticles that is intermediate the overall volumes of nanoparticles in the at least one portion and the at least another portion.

5. The cutting element of claim 4, wherein a distinct boundary between the at least one portion and the at least another portion is not discernible.

6. The cutting element of claim 1, wherein the at least one portion of the multi-portion polycrystalline diamond material comprises a first average grain size and the at least another portion of the multi-portion polycrystalline diamond material comprises a second, different average grain size.

7. The cutting element of claim 6, wherein the second, different average grain size is greater than the first average grain size.

8. The cutting element of claim 7, wherein the second, different average grain size is about one hundred (100) times greater than the first average grain size.

9. The cutting element of claim 7, wherein the first average grain size is greater than five hundred nanometers (500 nm).

10. The cutting element of claim 7, wherein the multi-portion polycrystalline diamond material further comprises a third portion having a third average grain size, the third average grain size being greater than the second average grain size.

11. The cutting element of claim 6, wherein the first average grain size is less than about five hundred nanometers (500 nm).

12. The cutting element of claim 1, wherein the at least one portion of the multi-portion polycrystalline diamond material comprises a cutting face of the cutting element.

13. The cutting element of claim 12, wherein the at least another portion extends over a top surface of the at least one portion.

14. The cutting element of claim 13, wherein the at least another portion further extends around sides of the at least one portion.

15. The cutting element of claim 1, wherein an interface between the at least one portion and the at least another portion is non-planar.

16. The cutting element of claim 1, wherein the at least one portion of the multi-portion polycrystalline diamond material comprises between about 0.01% to about 99% by volume nanoparticles.

17. The cutting element of claim 1, wherein the at least another portion of the multi-portion polycrystalline diamond material is at least substantially free of nanoparticles.

18. An earth-boring tool, comprising:

a body; and at least one cutting element attached to the body, the at least one cutting element comprising:

a hard polycrystalline diamond material comprising:

a first portion comprising a first volume of nanoparticles; and a second portion comprising a second volume of nanoparticles, wherein the first volume of nanoparticles differs from the second volume of nanoparticles, and wherein inter-granular bonds are formed between particles of the first portion and particles of the second portion.

19. The earth-boring tool of claim 18, wherein the first portion comprises a first average particle size and the second portion comprises a second average particle size, the second average particle size being greater than the first average particle size.

20. The earth-boring tool of claim 19, wherein the at least one cutting element further comprises a third portion having a third average particle size, the third average particle size being greater than the second average particle size.

* * * * *